US005697393A

United States Patent [19]

Mirlisena, Sr.

[11] Patent Number: 5,697,393

[45] Date of Patent: Dec. 16, 1997

[54] ADJUSTABLE ANTI-FREEZE FAUCET ASSEMBLY

[76] Inventor: John Raymond Mirlisena, Sr., 4615 Glenway Ave., Cincinnati, Ohio 45238

[21] Appl. No.: 426,280

[22] Filed: Apr. 21, 1995

[51] Int. Cl.[6] ..... F16L 5/00

[52] U.S. Cl. ..... 137/15; 137/359; 137/360; 137/801

[58] Field of Search ..... 137/801, 359, 137/360, 15

[56] References Cited

U.S. PATENT DOCUMENTS

| | | | |
|---|---|---|---|
| 2,687,141 | 8/1954 | Baker . | |
| 3,136,570 | 6/1964 | Lee | 137/360 |
| 3,188,120 | 6/1965 | Peterson | 137/360 |
| 3,971,401 | 7/1976 | Persson | 137/360 |
| 4,473,244 | 9/1984 | Hill . | |
| 4,475,570 | 10/1984 | Pike et al. . | |
| 4,662,389 | 5/1987 | Igbal | 137/360 |
| 4,932,686 | 6/1990 | Anderson, Jr. . | |
| 5,024,469 | 6/1991 | Aitken et al. . | |

*Primary Examiner*—A. Michael Chambers
*Attorney, Agent, or Firm*—Wood, Herron & Evans LLP

[57] ABSTRACT

An adjustable anti-freeze faucet assembly for mounting within a wall of the building comprises a telescoping water pipe with pieces configured for telescopic sliding movement to vary the length of the pipe, a faucet spout coupled to an outlet end of the pipe and a valve body mounted within the pipe proximate an inlet end. A valve handle is mounted proximate the pipe outlet end near the faucet spout, and a telescoping valve control stem extends in the pipe from the valve handle to the valve body. The control stem telescopes with the length of the pipe such that the valve body is maintained generally stationary with respect to the pipe length. When the faucet assembly is installed, the faucet spout and valve handle are at the cold outside surface, while the valve body is maintained proximate the warm inside surface of the building wall to prevent freezing of the water in the valve body and pipe.

12 Claims, 1 Drawing Sheet

ADJUSTABLE ANTI-FREEZE FAUCET ASSEMBLY

FIELD OF THE INVENTION

This invention relates generally to anti-freeze faucet assemblies and specifically to an anti-freeze faucet assembly which is adjustable in length.

BACKGROUND OF THE INVENTION

Water faucet assemblies are traditionally installed within building structures, such as a house, to deliver water outside of the building. These faucet assemblies are often referred to as "hose bibs" or "sillcocks" and generally include a pipe structure, a valve body and a water faucet or spout with a handle. The pipe structure has an inlet end, which is positioned at an inner surface of the wall and an outlet end, with the water faucet or spout, which is positioned at an outside wall surface. Due to the difference in temperature between the outside and the inside of the house or building, the inlet end of the water pipe structure is generally warmer than the outlet end and faucet. The valve body is preferably positioned as close to the inlet end as possible and is connected to the faucet handle at the outlet end by a control rod or stem, which extends between the handle and the body. Turning the faucet handle moves the stem and opens and closes the valve body. The valve body is preferably positioned close to the warm inlet end of the pipe structure so that when it is closed, all water drains out of the faucet and there is not water left in the pipe structure or faucet which would freeze when the outside temperature gets very cold.

Traditionally, anti-freeze faucet assemblies are made in a variety of different fixed lengths and vary in fixed two inch increments, for example, six, eight, ten, twelve, and fourteen inches. The length of the anti-freeze faucet assembly is determined by the width of the wall surface in which the faucet assembly is to be installed. As may be appreciated, an installer may be faced with installation in a number of different buildings, each having different wall thicknesses. As a result, contractors, suppliers, and plumbers are required to maintain a relatively large inventory of faucet assemblies to service their accounts.

To alleviate such large inventories, attempts have been made to produce a faucet assembly with a variable length. A patent of Persson, U.S. Pat. No. 3,971,401, discloses such an adjustable sillcock. Two adjustable pieces of a pipe are threaded together for varying the length. While the sillcock addresses the issue of adjustability, it does so by jeopardizing the operation of the assembly and its ability to prevent freezing water in the line. Particularly, as the outer piece of the sillcock is moved away from the inner piece to vary the length, the valve body moves with the outer piece closer to the outside surface of the wall. Therefore, the water in the line which is on one side of the valve body is also moved closer to the colder outer surface which promotes freezing within the line, reducing or defeating the effectiveness of the sillcock. Still further, such a sillcock is expensive to fabricate, requiring threads on the outside piece and corresponding threads on the inside piece to engage the outside threads for adjustability.

Another adjustable free-resistant hose bib is disclosed in Hill, U.S. Pat. No. 4,473,244. Despite the stated adjustability, however, the Hill hose bib requires that an outside tube be precisely measured and cut to a length which accommodates various wall thicknesses and hose bib dimensions. Therefore, the hose bib requires modification when being installed, thus increasing the time and expense in making such an installation. Additionally, if such a cut is not to the proper dimension, i.e., if it is too short, the piece would be useless and another piece would have to be measured, cut and utilized.

Accordingly, it is an objective of the invention to reduce the inventory which a contractor or plumber must carry in order to install an anti-freeze faucet assembly within a house or other structure.

It is further an objective of the present invention to provide an anti-freeze faucet assembly which is easily and simply installed without extensive modifications to either the assembly or the building structure, It is still another objective of the invention to provide an anti-freeze faucet assembly which maintains the relative position of a valve body close to the warmer side of the structure when adjusted for use in a variety of different structures having different wall thicknesses.

It is another objective of the invention to provide an anti-freeze faucet assembly which may be manufactured relatively inexpensively and installed with a minimum number of procedural steps and external parts.

SUMMARY OF THE INVENTION

The above-discussed and other objectives are addressed by the present invention, which is an adjustable antifreeze faucet assembly for mounting within the wall of a building structure. The faucet assembly comprises a water flow pipe having an inlet end and an outlet end and including an outside pipe piece and an inside pipe piece which are coupled together for adjusting the length of the water flow pipe. Both pieces have bores therethrough which cooperate for water flow through the pipe, and the inside piece is configured for sliding telescopic movement within the bore of the outside piece. The length of the water flow pipe is adjusted by telescoping the inside piece and the outside piece together or apart. A seal is positioned between the inside and outside pipe pieces for a water tight engagement of the pieces. When installed within a wall, the inlet end is positioned proximate the inside surface of the wall, which is generally warmed by the heat inside the building structure. The outlet end of the pipe is connected to a faucet and is positioned generally proximate the outside wall surface.

The water flow pipe further includes a valve body which is positioned proximate the inlet end, and a valve handle which is mounted with the faucet proximate the pipe outlet end. The faucet assembly of the present invention comprises a telescoping valve control stem extending in the pipe between the valve handle and the valve body. Moving the handle moves the control stem and opens and closes the valve. The valve stem is operable to telescope in length when the pipe length is adjusted within the pipe and maintains the valve body generally stationary and proximate the inlet pipe end, even when the pipe length is increased. Therefore, the valve always remains close to the warm inside surface of the wall to thereby prevent the freezing of water in the pipe. The valve body of the invention is maintained in a warm environment regardless of the width of the wall and the final installed length of the pipe.

The hose bib assembly of the invention is easily installed by determining the thickness of the wall and the necessary length of the flow pipe and then telescoping the flow pipe to the determined length. In one embodiment of the invention, the seal is a packing gland fixed to an end of the outside pipe piece and operable to be tightened against the inside pipe piece to fix the length of the pipe and to seal the pieces together in a water-tight seal. Alternatively, a gasket might be recessed within the end of the outside piece for a water tight seal, whereby the inside piece remains freely slidable with respect to the seal and outside piece after installation, Once installed, the plumbing of the structure is connected to the inlet end and the faucet assembly is ready for operation.

While the unique construction of the anti-freeze faucet assembly of the present invention is particularly suitable for its primary purpose, the water flow pipe construction and telescoping valve control stem might also be utilized with other structures, such as fire hydrants and animal watering assemblies wherein an adjustable hose is necessary and the valve body needs to be maintained in a fixed position within the pipe regardless of the length of the pipe, The faucet assembly of the invention is relatively inexpensive to manufacture and may be easily and quickly installed without a large number of external pieces. Furthermore, no physical modifications of the faucet assembly are necessary for installation. The invention is particularly useful for tight installations wherein the water flow pipe length cannot extend through the visible inside wall, such as drywall, and must stay between the drywall and the structure wall. The invention eliminates the necessity for the contractor or plumber to carry a large inventory of faucet assemblies.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
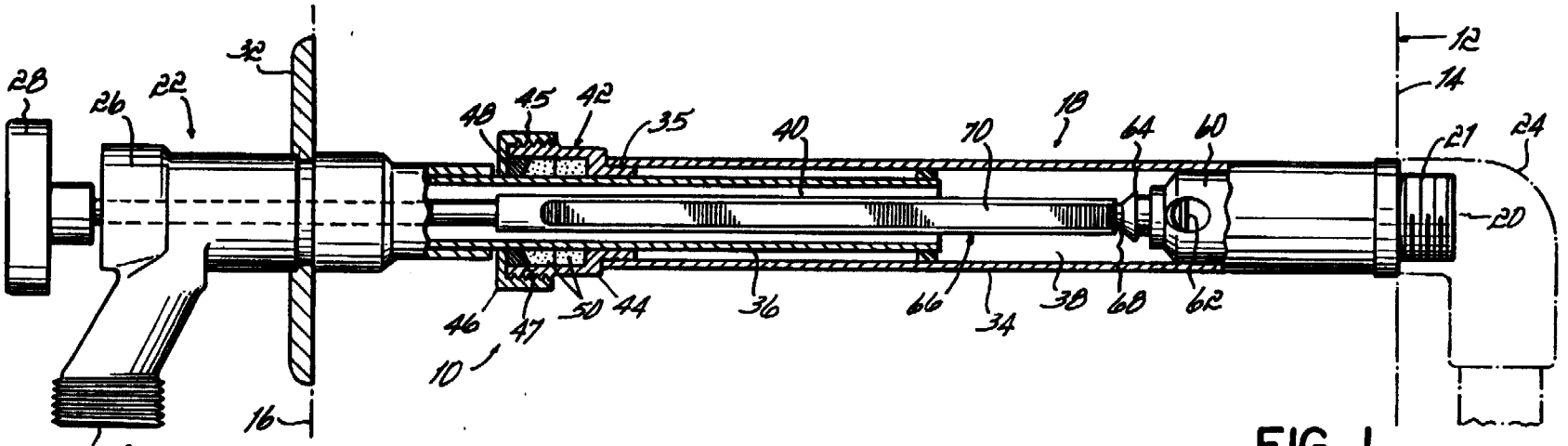
FIG. 1 is a side view, in partial cross-section, of the faucet assembly of the present invention.

FIG. 1 illustrates the anti-freeze assembly 10 of the present invention, which is configured to fit within the wall 12 of a building, such as a house, and to extend from an inside wall surface 14 to an outside wall surface 16. The inside surface 14 faces the inside of the house or other building, while the outside surface 16 faces the outside environment. In accordance with the principles of the invention, the faucet assembly telescopes in length to fit the thickness of wall 12.

The faucet assembly 10 has a water flow pipe 18 having an inlet end 20 proximate the inside surface 14 and an outlet end 22 proximate the outside surface 16. The inlet end 20 preferably has a threaded end 21 and is coupled to the inside plumbing of the building, such as an elbow 24. The elbow 24 couples to other water pipes (not shown) which would travel down the side of wall 12 between wall 12 and another inside decorative wall, such as drywall, (not shown) such that the faucet assembly 10 is generally not visible from the inside of the building. Alternatively, the inlet end 20 might continue its straight course out into a room behind wall 12. A faucet structure 26 having a water spout 30 is appropriately connected to water flow pipe 18 proximate the outlet end 22 as is understood by a person of ordinary skill in the art. Faucet structure 26 has a valve handle 28 coupled thereto and is secured against surface 16 of wall 12 with a flange or collar 32.

In accordance with the principles of the present invention, the water flow pipe 18 comprises an outside piece 34 and an inside piece 36. As illustrated in FIG. 1, the inside and outside piece 34, 36 have bores 38, 40, respectively, therethrough. The bores 38, 40 cooperate so that water flows from the inlet end 20 to the outlet end 22 of pipe 18 and out the faucet spout 30. The inside piece 36 is preferably tubular and has a smaller diameter than the tubular outside piece 34. The inside piece 36 is configured to slide within bore 38 of the outside piece 34, and therefore, the inside piece 36 and outside piece 34 will generally be telescopically engaged. The length of the water flow pipe 18 is adjusted by telescoping the inside piece 36 within the outside piece 34. Therefore, depending on the length dimensions of pipe 34, 36, the faucet assembly 10 may be adjusted in length to adapt to a variety of different wall thicknesses. In that way, the plumber, contractor, or other installer does not have to maintain a large inventory of different faucet assemblies for different building and wall thicknesses. Furthermore, as discussed further hereinbelow, virtually no physical modification of the faucet structure is necessary during installation to insure an optimal fit. In the embodiment of the invention illustrated in the Figures, the inside piece 36 defines the outlet end of the pipe 18, and the larger diameter outside piece 34 defines the inlet end 20. Alternatively, the pieces might be reversed in orientation with the larger outside piece 34 defining the outlet end 22 and the smaller inside piece 36 defining the inlet end 20 without deviating from the scope of the present invention.

The water flow pipe 18 of assembly 10 includes a sealing structure or seal, such as a packing gland 42. Packing gland 42 includes a seal seat section 44 formed with threads 45 and appropriately connected to the end of the outside pipe piece 34 at overlap 35 for a water-tight seal. A rotating cap section 46 with corresponding threads 47 rotates to tighten down upon seat section 44 to compress a wedge gasket 48 against one or more sealing gaskets 50. This, in turn, compresses the sealing gaskets 50 between the seat 44 and the surface of the inside piece 34 to seal the inside and outside pipe pieces together. Packing gland 42 forms a water-tight seal between the outside piece 34 and inside piece 36 to prevent leakage out of pipe 18. The packing gland also acts as a joint, such that when the packing gland 42 has been tightened, the pipe pieces are secured against each other and the length of the pipe 18 is generally fixed. The cooperating bores 38, 40 form a continuous water flow passage from the inlet end 20 to the outlet ends 22 of pipe 18.

Figure 3:
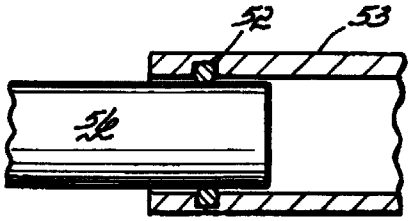
FIG. 3 is a partial cross-sectional view of an alternative sealing structure for the faucet assembly of the present invention.

FIG. 3 illustrates an alternative embodiment of a sealing structure for the faucet assembly 10 of the invention. A circular groove or recess 52 is formed within the outside piece 53 to receive a circular gasket or sealing ring 54, such as an O-ring. The sealing ring 54 encircles the inside piece 56 and forms a water-tight seal between the outside and inside pieces 53, 56, respectively. Seal 54 is configured to allow free telescopic movement of the outside and inside pieces 53, 56, but is constructed to maintain a water-tight seal when the water flow pipe 18 is extended to the desired length. The sealing structure of FIG. 3 eliminates the cost of a separate packing gland seal 42. The piece 53 is shown to be thick enough to accommodate groove 52. However, if piece 53 is thin-walled, as may be the case with a copper outside piece, a ridge (not shown) may need to be formed above the surface of outside piece 53 for accommodating the ring 54.

Figure 2:
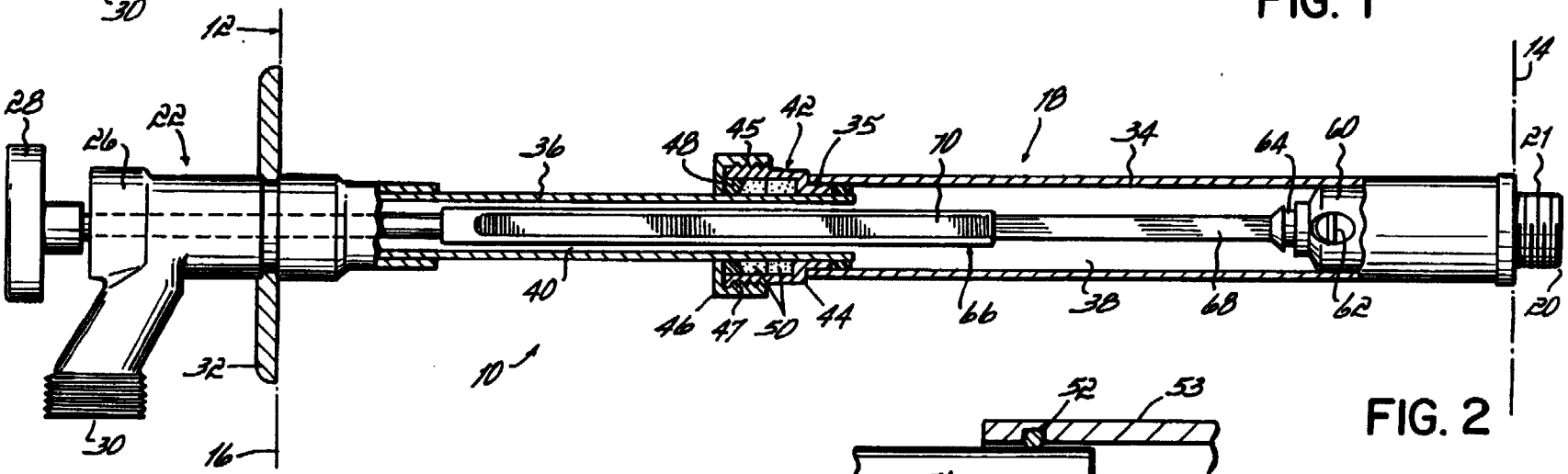
FIG. 2 is a side view, in partial cross-section, of the faucet assembly of FIG. 1 shown in a more extended state.

In accordance with the principles of the present invention, faucet assembly 10 further comprises a valve body 60 having a water flow aperture 62, which is opened and closed by rotation of a hub 64 for allowing water to flow through pipe 18 and out the spout 30. The valve body 60 is positioned inside the outside piece 34 proximate the pipe inlet end 20. Hub 64 is connected to rotatable valve handle 28 by a valve control stem 66, which extends through bores 38, 40 of the pipe 18 from handle 28 to the valve body 60. Rotation of handle 28 rotates stem 66, which, in turn, rotates hub 64 and opens and closes the aperture 62 for water flow in pipe 18. The valve control stem 66 telescopes in length and includes an inside piece 68 which slides in and out within a larger diameter outside piece 70. The telescoping valve control stem 66 thereby is operable to telescope in length when the length of pipe 18 is adjusted. The combination of the telescoping water flow pipe 18 and the telescoping valve control stem 66 of the present invention produces a faucet assembly 10, which maintains the valve body 60 proximate the warmer inlet 20 of pipe 18 regardless of the length of the assembly. The valve body 60 is maintained proximate the warmer inside surface 14 of wall 12 and away from the cold outside environment. This insures that faucet pipes having water therein are kept warm to prevent freezing within those pipes and within the faucet assembly 10. As illustrated in FIG. 2, even when the water flow pipe 18 of the faucet assembly 10 has been extended or telescoped to its longest position, the valve body 60 is still maintained proximate the warmer inlet end 20 of the pipe 18.

The faucet assembly is simple to install and requires no physical modification of pipe 18. First, the thickness dimension of wall 12 is determined, and if it does not already exist, an opening is formed through wall 12 from the inside surface 14 to the outside surface 16. From the measured thickness dimension of the wall, the length of the water flow pipe 18, which is necessary for installation within the wall is determined, the inside pipe piece 36 is telescoped within the outside pipe piece 34 to vary the length of the water flow pipe 18 to generally match the length of the opening or the thickness of the wall 12. With collar 32 against wall 12, the length of the pipe 18 is adjusted until the pipe inlet end 20 is positioned proximate the inside wall surface 14 at the desired position. When the length of pipe 18 is varied, the valve control stem 66 is also telescoped in length to maintain the valve body 60 proximate the inside wall surface 14 and the warm environment inside the building. When the proper length for the faucet assembly 10 has been determined, the packing gland 42 may be tightened to fix the length of pipe 18 at the desired position. Thereafter, faucet assembly 10 is connected to the internal plumbing, such as to a cold water line, and is effective to prevent freezing within the pipe 18 and faucet structure 26 during usage. The faucet assembly 10 also prevents water from freezing further in the pipes within the building.

Faucet assembly 10 of the invention is relatively inexpensive to manufacture and is quickly and easily installed because it does not require any physical modification when being installed. Furthermore, the faucet assembly 10 may be adjusted to various lengths without jeopardizing the anti-freeze properties of the assembly, because the valve body 60 is maintained in a warm environment by the telescoping valve control stem 66 of the invention.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of installing an anti-freeze faucet assembly within the wall of a building having inside and outside surfaces comprising:

positioning a water flow pipe having an inlet end and an outlet end within an opening formed in the wall between the inside and outside surfaces, the pipe having a faucet spout coupled to the outlet end thereof and including an outside pipe piece and an inside pipe piece configured for telescopic sliding movement within the outside pipe piece;

from the width of the wall, determining the length of the water flow pipe necessary for installation within the wall;

telescoping the inside pipe piece within the outside pipe piece to vary the length of the water flow pipe to generally match the necessary length;

adjusting the length of the pipe to position the pipe inlet end and a valve body within the pipe proximate the inside wall surface and to position, proximate the outside wall surface, the faucet spout and pipe outlet end and a valve handle coupled to the pipe at the outlet end;

while telescoping and adjusting the pipe length, telescoping a valve control stem extending in the pipe from the valve handle to the valve body to vary the length of the stem with the length of the pipe such that the stem is moved by the valve handle for opening and closing the valve at the inside surface and the valve body is maintained proximate the inside wall surface;

whereby the anti-freeze faucet assembly may be installed in walls having different thicknesses and the valve body is effectively maintained proximate the inlet pipe end and the inside surface of the structure wall regardless of the wall thickness to effectively reduce the freezing of water in the pipe.

2. The method of claim 1 wherein the pipe includes a joint assembly operably coupled between the inside and outside pipe pieces and further comprising tightening the joint assembly when the pipe and valve stem are at the proper length for securing one of the pipe pieces against the other of the pieces and fixing the length of the pipe.

3. The method of claim 2 wherein the joint assembly includes a sealing structure and further comprising sealing the two pipe pieces together in water-tight engagement when the length of the pipe is fixed.

4. An adjustable anti-freeze faucet assembly for mounting within a wall of a building comprising:

a water flow pipe having an inlet end for positioning proximate an inside surface of the wall and an outlet end for positioning proximate an outside surface of the wall, the pipe including an outside piece and an inside piece, both pieces having bores therethrough which cooperate for water flow through the pipe;

the inside piece being configured for telescopic sliding movement within the bore of the outside piece and the length of the water flow pipe being adjustable by telescoping the inside piece and the outside piece;

a faucet spout coupled to the outlet end of the pipe;

a valve body mounted within the water flow pipe proximate the pipe inlet end and a valve handle mounted proximate the pipe outlet end and faucet spout;

a telescoping valve control stem extending in the pipe from the valve handle to the valve body, the handle movable to move the control stem for opening and closing the valve, the valve stem being operable for telescoping in length when the pipe length is adjusted to maintain the valve body generally stationary with respect to the pipe length and proximate the inlet pipe end and the inside surface of the building wall to prevent freezing of water in the valve body and pipe.

5. The faucet assembly of claim 4 further comprising a seal positioned between the inside pipe piece and the outside pipe piece for coupling the cooperating pipe bores together in water-tight engagement, the seal providing smooth telescoping of the inside and outside pipe pieces.

6. The faucet assembly of claim 5 wherein the seal is positioned at an end of the outside pipe piece for sealing said end to the inside pipe piece.

7. The faucet assembly of claim 5 wherein the seal includes a packing gland fixed to the outside pipe piece which is operable to be tightened against the inside pipe piece to seal the pipe pieces together.

8. The faucet assembly of claim 5 wherein the outside pipe piece defines the inlet end of the water flow pipe and the inside pipe piece defines the outlet end of the water flow pipe.

9. The faucet assembly of claim 5 further comprising a joint assembly coupled between the inside and outside pipe pieces, the joint assembly operable for tightening one of the pipe pieces against the other of the pieces for fixing the length of the pipe.

10. A water flow pipe assembly having an inlet end and an outlet end and comprising:

an outside piece;

an inside piece, both pieces having bores therethrough which cooperate for water flow through the pipe;

the inside piece being configured for telescopic sliding movement within the bore of the outside piece and the length of the water flow pipe being adjustable by telescoping the inside piece and the outside piece;

a valve body mounted within the water flow pipe proximate the pipe inlet end and a valve handle mounted proximate the pipe outlet end;

a telescoping valve control stem extending in the pipe from the valve handle to the valve body, the handle movable to move the control stem for opening and closing the valve, the valve stem being operable for telescoping in length when the pipe length is adjusted to be adapted for installations requiring different lengths of flow pipe and to maintain the valve body generally stationary with respect to the pipe length and proximate the inlet pipe end regardless of the length of the water flow pipe to maintain the valve body in a warm environment and prevent water from freezing in the pipe.

11. The water flow pipe assembly of claim 10 further comprising a seal positioned between the inside pipe piece and the outside pipe piece for coupling the cooperating pipe bores together in water-tight engagement, the seal providing smooth telescoping of the inside and outside pipe pieces.

12. The water flow pipe assembly of claim 10 further comprising a joint assembly coupled between the inside and outside pipe pieces, the joint assembly operable for tightening one of the pipe pieces against the other of the pieces for fixing the length of the pipe.

* * * * *